US010087727B2

(12) United States Patent
Segura et al.

(10) Patent No.: US 10,087,727 B2
(45) Date of Patent: Oct. 2, 2018

(54) EXPOSED ENERGETIC DEVICE INITIATION VIA TUBING CONVEYED FIRING MECHANISM

(71) Applicant: Weatherford Technology Holdings, LLC, Houston, TX (US)

(72) Inventors: John W. Segura, Houston, TX (US); Clifford L. Hicks, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 252 days.

(21) Appl. No.: 15/015,343

(22) Filed: Feb. 4, 2016

(65) Prior Publication Data

US 2017/0226829 A1 Aug. 10, 2017

(51) Int. Cl.
*E21B 43/1185* (2006.01)

(52) U.S. Cl.
CPC ..... *E21B 43/11855* (2013.01)

(58) Field of Classification Search
CPC ..... E21B 43/11855; E21B 43/1185; E21B 43/116
See application file for complete search history.

(56) References Cited

U.S. PATENT DOCUMENTS 4,648,470 A 3/1987 Gambertoglio
4,658,900 A * 4/1987 Stout ..... E21B 43/11855 166/297
5,007,344 A 4/1991 Ricles et al.
5,054,555 A 10/1991 Lalande et al.
5,540,293 A * 7/1996 Mohaupt ..... E21B 43/11855 166/297
5,680,905 A 10/1997 Green et al.
6,394,184 B2 5/2002 Tolman et al.
7,363,860 B2 4/2008 Wilson et al.
8,931,569 B2 1/2015 Fagley, IV et al.
2009/0250223 A1 10/2009 Erkol et al.

FOREIGN PATENT DOCUMENTS

EP 0931907 A2 7/1999

OTHER PUBLICATIONS

Cosad, C., "Choosing a Perforating Strategy," Oilfield Review, Oct. 1992.
Weatherford, "Tubing-Conveyed Perforating," Brochure, copyright 2013.
PCT Search Report received in co-pending PCT Application No. PCT/US2017/015624 dated May 3, 2017, 12-pgs.

* cited by examiner

*Primary Examiner* — Brad Harcourt
(74) *Attorney, Agent, or Firm* — Blank Rome, LLP

(57) ABSTRACT

A mechanical firing system is used to detonate energetic material, such as external perforating charges, disposed on an apparatus deployed on tubing in a wellbore. In one embodiment, a through-bulkhead explosive energy transfer is used to deliver the detonation from the mechanical firing system to an external detonator. In another embodiment, the mechanical firing system delivers an electric pulse to initiate a detonator. A through-wire pressure bulkhead isolates the source of electric power from the wellbore environment. The electrical source can be a magneto-based device or can use a piezoelectric device.

21 Claims, 4 Drawing Sheets

EXPOSED ENERGETIC DEVICE INITIATION VIA TUBING CONVEYED FIRING MECHANISM

BACKGROUND OF THE DISCLOSURE

After casing is cemented in a wellbore and any residual cement is cleaned out, operations are commonly performed to perforate the casing to establish fluid communication with the surrounding formation for fracture operations and eventual production. Various types of perforating equipment can be used to perforate the casing.

Wireline conveyed perforating equipment is one type of equipment used for perforating casing. For example, FIG. 1A illustrates a through-casing perforating gun 20 deployed in a wellbore 10 with wireline 24 from a wireline truck 26. The gun 20 has shaped charges 22 that produce perforations 14 in the casing 12 of the wellbore 10.

As another example, FIG. 1B illustrates a through-tubing perforating gun 30 deployed in a wellbore 10 with wireline 34 from a wireline truck 26. The gun 30 has shaped charges 32 that produce perforations 14 in the casing 12 of the wellbore 10. The charges 32 are exposed in the wellbore 10, and magnets can hold the gun 30 against the casing 12.

Tubing Conveyed Perforating (TCP) equipment is another type of equipment used for perforating casing. In this form of perforating operation, the TCP equipment consisting of one to ten guns is conveyed downhole to prepare the wellbore casing with perforations. The TCP equipment, which is nonelectric, then establishes the perforations in the casing and can be conveyed on coil tubing or on pipe.

For example, FIG. 1C illustrates a tubing-conveyed perforating (TCP) gun 40 deployed on a workstring 44, such as coiled tubing or jointed pipe, from a rig 46. The guns 42 are encapsulated in a housing, which can have flow entry ports 45 adjacent a firing head.

In the pipe-conveyed operation, multiple pressure-activated firing heads of the TCP gun 40 can be fired at the same time and may or may not have time delays attached. Pipe tally for the pipe 44 is used to correlate the position of the TCP equipment downhole in the casing 12, and a packer may or may not be run to isolate the annulus.

In the coil tubing-conveyed operation, one pressure-activated firing head or ball-drop-differential firing head fires first in the TCP equipment. Then, time delays between gun activations can allow the coil tubing 44 to move the TCP equipment to different zones to be perforated. In the end, the number of charges 42 that can be run and the different zones that can be perforated may be limited by the equipment at surface. A depth recorded from a clean-out run with the coil tubing 44 can be used to correlate the position of the TCP equipment downhole to the zones to be perforated.

As shown, the guns for perforating equipment come in two basic forms, exposed guns 30 as in FIG. 1B and hollow carrier guns 20, 40 as in FIGS. 1A and 1C. The exposed gun 30 is run on wireline and has its shaped charges 32 individually mounted on a strip, in a tube, or on a wire. The detonator and detonating cord for the charges 32 are exposed in the wellbore 10 to surrounding fluids.

For operation, the wireline system of FIG. 1B uses an electrical firing mechanism to initiate the firing process for the gun 30. In this process, an electrical initiation is communicated through the wireline 34 to the gun 30 to initiate the firing. In some operations, exposed energetic products cannot or are difficult to deploy on electric wireline. Yet, in some instances, exposed energetic products may still be useful.

The subject matter of the present disclosure is directed to overcoming, or at least reducing the effects of, one or more of the problems set forth above.

SUMMARY OF THE DISCLOSURE

An apparatus according to the present disclosure is conveyed downhole in a wellbore using tubing. The apparatus includes a body, a barrier, energetic material, a firing mechanism, and a detonation mechanism. The body has a first portion in fluid communication with the tubing and has a second portion exposed in the wellbore. The barrier seals between these two portions. For its part, the energetic material is disposed on the second portion and is connected to one or more detonating cords extending toward the barrier. In general, the energetic material can be one or more perforating charges, propellant materials, oxidizers, cutters, string shots, and the like.

The firing mechanism is disposed in the first portion and is mechanically actuated. The detonation mechanism is at least partially disposed in the first portion. In response to the mechanical actuation of the firing mechanism, the detonation mechanism initiates a detonation and transfers the detonation across the barrier to the one or more detonating cords for the energetic material, which in turn perforate the casing or perform some other desired function.

In one embodiment, the firing mechanism has a firing pin that is movable to a firing position in response to fluid pressure from the tubing. The detonation mechanism in turn includes a detonator disposed in the first portion relative to the firing pin. The detonator is detonated in response to the firing pin moved to the firing position. A ballistic transfer in communication with the detonator then transfers the detonation from the detonator across the barrier to the one or more detonating cords for the energetic material. In general, the barrier can use a membrane composed of metal that seals fluid communication between the first portion and the wellbore to which the second portion is exposed.

The first portion can include a sleeve movable therein in response the fluid pressure from the tubing to move the firing pin to the firing position. For example, a seat on the sleeve can engage a plug or ball deployed down the tubing. The seat seals with the plug and then permits the fluid pressure from the tubing to move the sleeve and the firing pin to the detonator.

In another embodiment, the detonation mechanism can include an electric source disposed in the first portion that produces an electric pulse in response to the mechanical actuation of the firing mechanism. In this instance, the barrier can use a sealed bulkhead between the first portion and the wellbore to which the second portion is exposed. The sealed bulkhead can pass at least one conductor for the electric pulse from the electric source to the one or more detonating cords for the energetic material. The electric source can be a magneto-based device or a piezoelectric device.

A method according to the present disclosure energizes energetic material downhole in a wellbore. A barrier is sealed between first and second portions of an apparatus. The first portion connects to tubing, and the energetic material is disposed on the second portion. The apparatus deploys on the tubing downhole in the wellbore with the first portion in fluid communication with the tubing and with the second portion exposed in the wellbore. A firing is mechanically actuated in the first portion, and a detonation is initiated in the first portion in response to the mechanical actuation of the firing. The detonation then transfers across the barrier to the energetic material exposed in the wellbore on the second portion.

As disclosed herein, a mechanical firing system is used to detonate energetic material, such as external devices, perforating charges, etc. In one embodiment, a through-bulkhead explosive energy transfer is used to deliver the detonation from the mechanical firing system across a barrier to the external detonator. In another embodiment, the mechanical firing system delivers an electric pulse to initiate a detonator. A through-wire pressure bulkhead isolates the source of electric power from the wellbore environment.

The foregoing summary is not intended to summarize each potential embodiment or every aspect of the present disclosure.

DETAILED DESCRIPTION OF THE DISCLOSURE

Figure 1C:
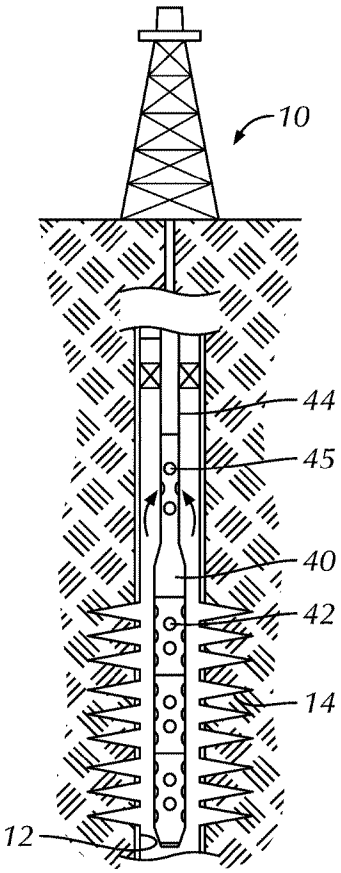
FIGS. 1A-1C illustrate perforating techniques according to the prior art.
Figure 1B:
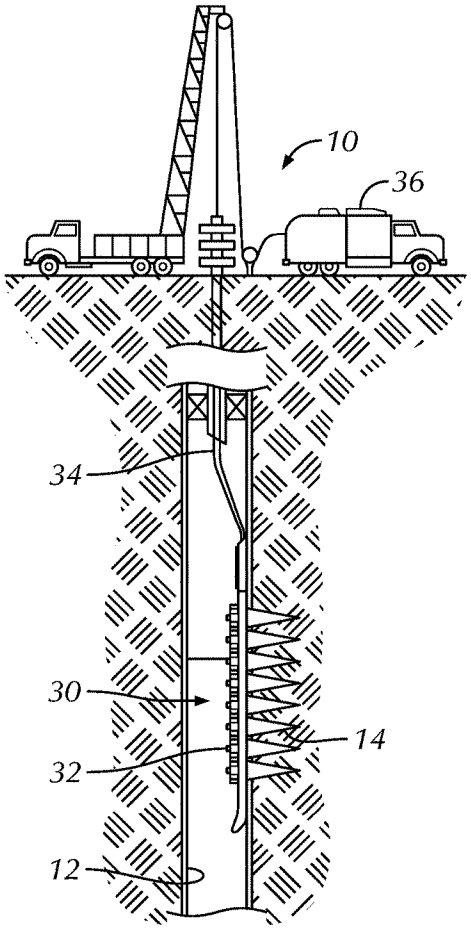
Figure 1A:
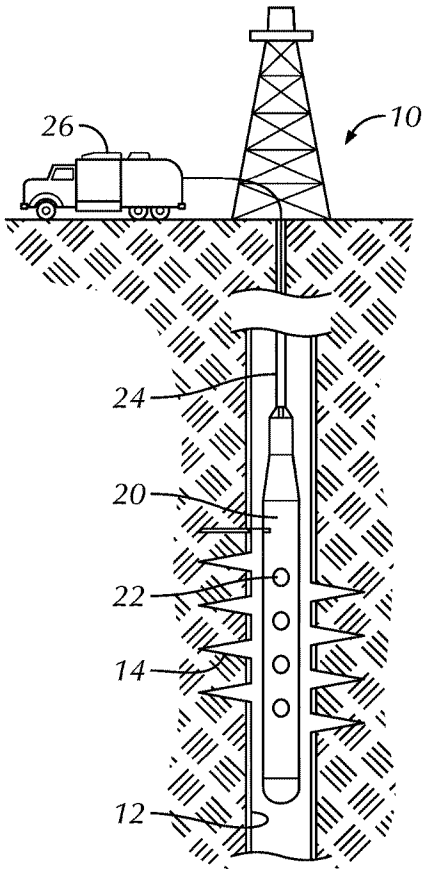
Figure 2:
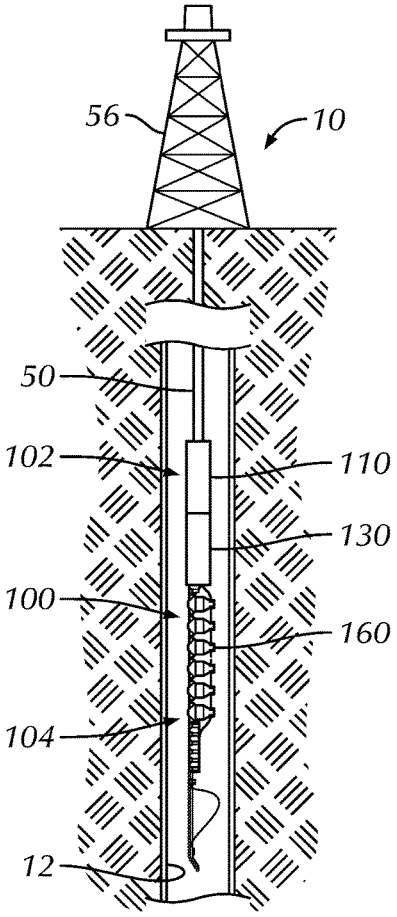
FIG. 2 illustrates a perforating technique according to the present disclosure.

FIG. 2 illustrates an example of a tubing conveyed apparatus 100 of the present disclosure deployed in a wellbore 10 on a workstring 50, such as coiled tubing or jointed pipe, from a rig 56. For simplicity, the workstring 50 is referred to herein as "coiled tubing" or just "tubing." A first portion 102 of the apparatus 100 has a firing mechanism 110 and a detonation mechanism 130, while a second portion 104 has external energetic elements 160.

The firing mechanism 110 is coupled to the tubing 50 and is mechanically actuated. The detonation mechanism 130 produces a detonation in response to the actuated firing of the firing mechanism 110 and transfers the detonation from an interior of the first portion 102 to the external components of the second portion 104. Exposed in the wellbore 10, for example, the energetic elements 160 are detonated by the transferred detonation. For example, the energetic elements 160 can be shaped charges that produce perforations (not shown) in the casing 12 of the wellbore 10. As such, the apparatus 100 can be a tubing conveyed perforating (TCP) apparatus or gun used for perforating the casing 12 downhole.

Figure 3:
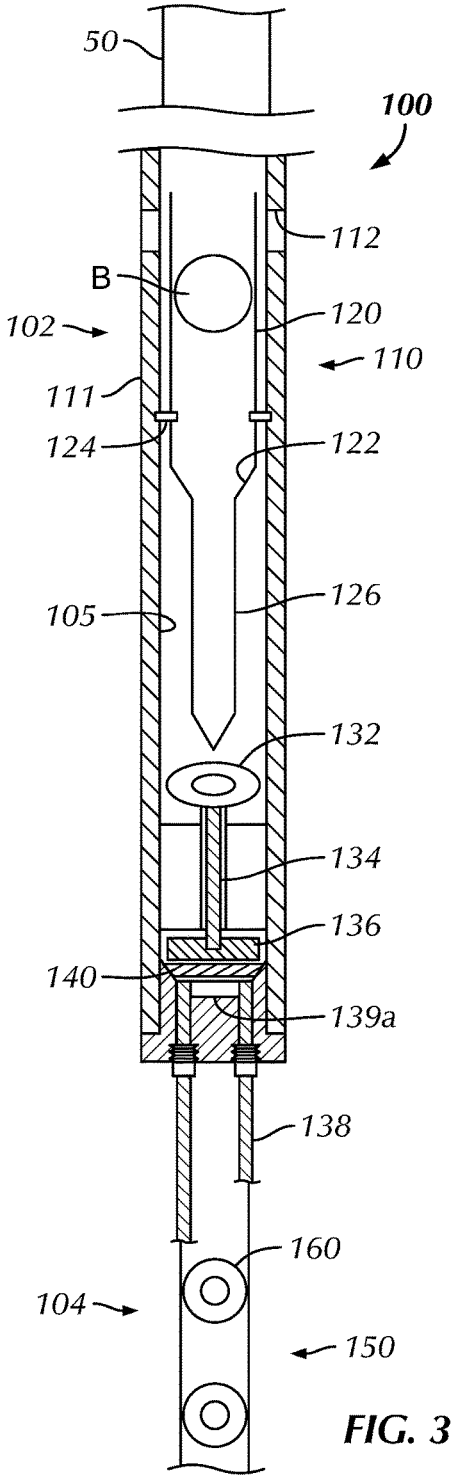
FIG. 3 schematically illustrates a tubing conveyed apparatus according to the present disclosure.
Figure 4A:
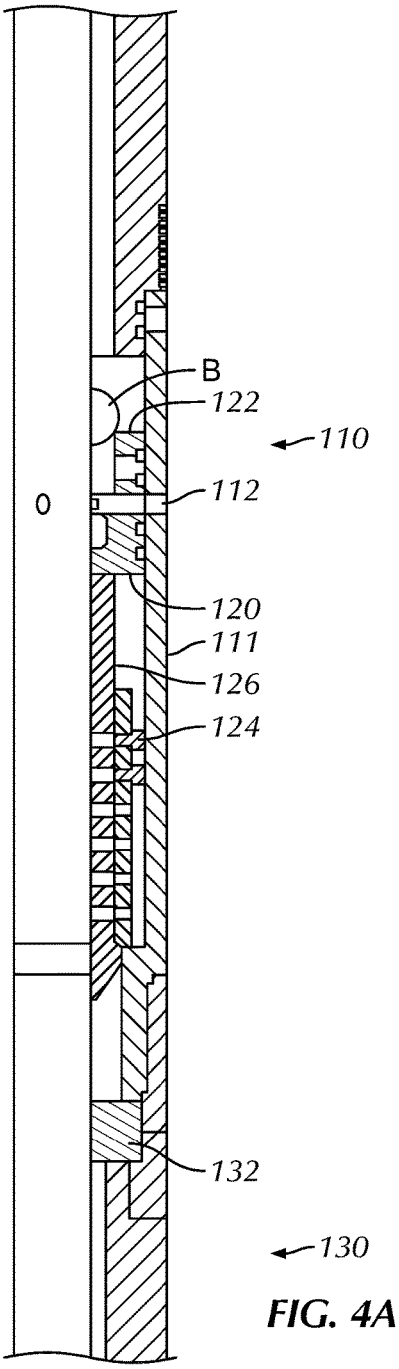
FIG. 4A illustrates a partial cross-sectional view of a firing mechanism for the disclosed apparatus.
Figure 4B:
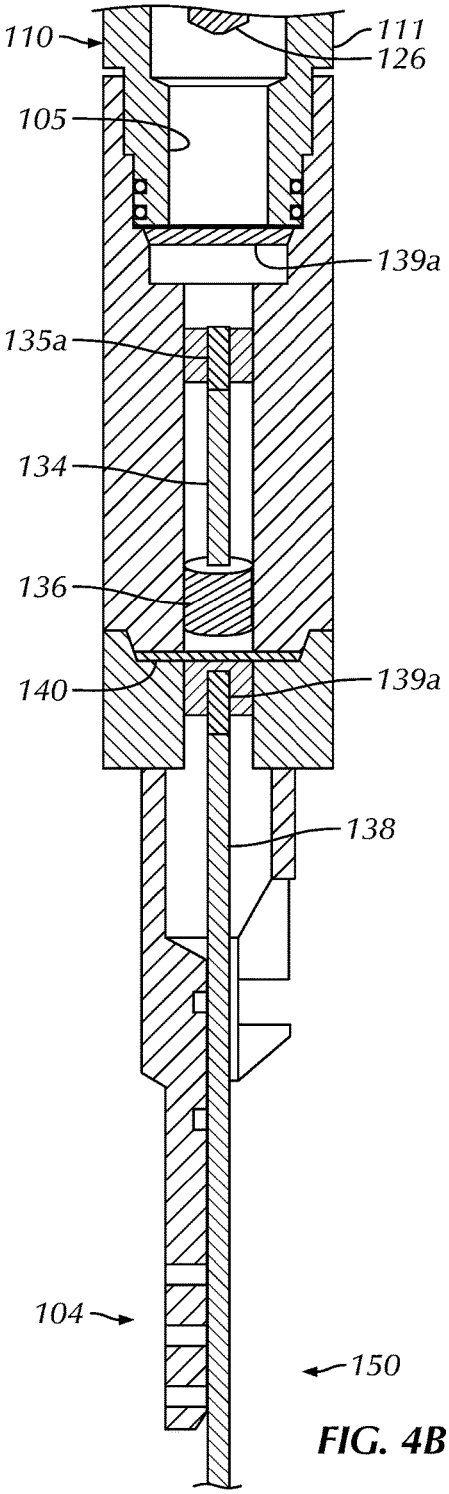
FIG. 4B illustrates a cross-sectional view of portion of the firing mechanism along with a detonation mechanism for the disclosed apparatus.
Figure 4C:
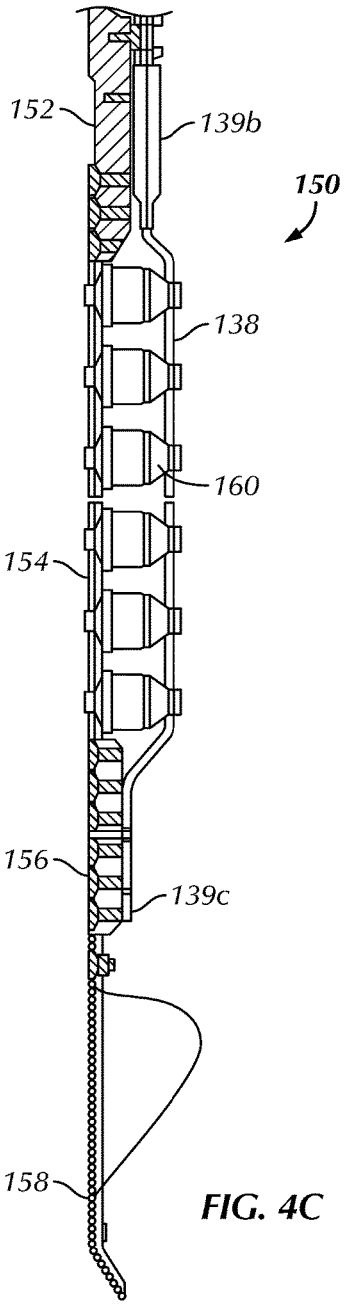
FIG. 4C illustrates an elevational view of an external array of energetic members for the disclosed apparatus.

FIG. 3 schematically illustrates the tubing conveyed apparatus 100 according to the present disclosure. Detailed views of various sections of the apparatus 100 are depicted in FIGS. 4A-4C, which may be concurrently referenced. The apparatus 100 is conveyed by tubing 50 in the wellbore in a manner similar to the techniques discussed above. The tubing 50 can be coiled tubing, jointed pipe, or the like and can be deployed with coil tubing equipment, a rig, and the like.

As indicated above, the apparatus 100 includes a body having first and second portions 102 and 104. The first portion 102 is in fluid communication with the tubing 50, whereas the second portion 104 is exposed in the wellbore when deployed therein. A barrier 140 seals between the first and second portions 102 and 104.

The apparatus 110 has a tubing-conveyed firing mechanism 110 at the first portion 102. The firing mechanism 110 initiates a detonation mechanism 130 that transfers ballistic force from a hollow chamber 105 of the first portion 102 and through the barrier 140 with sufficient residual or direct energy to initiate detonation of the components of the second portion 104 external to the environmentally-protected chamber 105. This transfer of ballistic energy then detonates boosters 139*a* and/or detonating cords 138 as a part of a larger detonation chain of energetic members 160 on the second portion 104. These energetic members 160 can be perforating charges, propellant materials, oxidizers, energetic materials, cutter, string shots, or any other energetic devices utilized within or external to a wellbore.

As noted above, the first portion 102 includes the firing mechanism 110 for initiating firing of the energetic members 160 on the second portion 104. A firing pin 126 disposed in the first portion 102 is movable to a firing position in response to fluid pressure from the tubing 50. A detonator 132 disposed in the first portion 102 relative to the firing pin 126 can then be detonated in response to the moved firing pin 126, and a ballistic transfer 136 in communication with the detonator 132 transfers the detonation from the detonator 132 across the barrier 140 to one or more detonating cords 138 for the one or more energetic member 160 on the exposed portion 104 of the apparatus 100.

Looking at the firing mechanism 110, which is also shown in detail in FIGS. 4A-4B, a sleeve 120 is disposed in the housing 111 of the firing mechanism 110. The sleeve 120 has a seat 122 and is movable in the housing 110 by engaging a plug or ball B deployed from surface down the tubing 50. When the ball B engages in the seat 122, tubing pressure behind the seated ball B shifts the sleeve 120 free from of shear pins 124 or other temporary connections and forces the firing pin 126 toward the detonator 132. Shifting of the sleeve 120 can also move the sleeve 120 relative to external ports 112 on the mechanism's housing 111 to allow fluid communication from the tubing 50 to the surrounding wellbore.

The firing pin 126 moved by the sleeve 120 then initiates the detonation mechanism 130 of the apparatus 100. As best shown in the detail of FIG. 4B, the detonation mechanism 130 has the detonator 132, such as a percussive detonator that is breached by the pin 126 driven by the sleeve's movement. A booster 135*a* adjacent the percussive detonator 132 transfers the detonation to a detonating cord 134 that delivers the detonation to the transfer 136 disposed adjacent the apparatus' barrier 140.

As best shown in FIG. 4B, the barrier 140 is a metal membrane of sufficient thickness to seal the firing and detonation mechanisms 110 and 120 from the wellbore. In this way, the barrier 140 provides atmospheric encapsulation for the firing and detonation mechanisms 110, 130 so that the booster 135*a* and the detonation cord 134 are encapsulated within the housing's chamber 105 of air and protected from the fluid environment in the wellbore.

The transfer 136 is an explosive transfer pellet 136 that explodes with the delivered detonation from the detonating cord 134 and transfers the detonation across the barrier 140 to one or more other boosters 139*a* exposed on the other side of the barrier 140. The one or more boosters 139*a* then transfer the detonation to the one or more exposed detonating cords 138 extending on the second portion 104 of the apparatus 100 to the one or more energetic members 160.

As best shown in FIG. 4C, the second portion 104 of the apparatus 100 includes an exposed or external array 150 of energetic members 160. In the present embodiment, the energetic members 160 are shaped charges, and the array 150 can be similar to a perforating gun used for wireline conveyed perforating. The array 150 includes an extension 152 from the firing and detonation mechanisms 110 and 120 that supports a carrier strip 154 on which the various energetic members 160 are mounted. The strip 154 can have an adapter 156 for connecting to a tandem strip (not shown) for additional energetic members, although FIG. 4C shows a nose 158 connected to the adapter 156 instead.

The one or more exposed detonating cords 138 extend from a boot 139*b* to the energetic members 160 on the carrier strip 154. If no tandem arrangement is used, the end of the cords 138 can be held by a holder 139*c* at the adapter 156.

During operation, the mechanical firing head 110 begins the detonation chain via mechanical activation, such as the firing pin 126 driven by the sleeve 120, seated ball B, and tubing pressure. The detonator 132 initiates the upper detonating cord 134, which is configured to initiate the explosive transfer pellet 136. The cord 134 is encapsulated within the housing's chamber 105 of air and protected from the fluid environment in the wellbore.

The transfer pellet 136 detonates, rupturing the barrier 140 and transferring the ballistic energy. The explosive transfer pellet 136 is of sufficient quantity to initiate one or more external pieces of detonating cord 138 through the barrier 140 of thin metal membrane designed to withstand a certain amount of hydrostatic pressure. The external detonating cord 138 and/or boosters 139*a* then initiate and begin the ballistic delivery to attached energetic members 160.

As already noted above, the energetic members 160 as depicted in FIG. 4C are perforating charges. Rather than perforating as shown here, energetic members for other processes can benefit from the present disclosure. In general, the energetic members 160 can be oxidizers, propellants, cutters, string shots, and other energetic materials. In one particular example, the energetic members 160 can be used for long propellant-based stimulation.

As disclosed herein, a mechanical firing system is used to detonate external devices, such as the energetic members 160 of shaped charges and the like. In one embodiment, the through-bulkhead explosive energy transfer in the form of the detonation mechanism 130 is used to deliver the detonation from the mechanical firing system to the external detonator components through a barrier 140.

Figure 5:
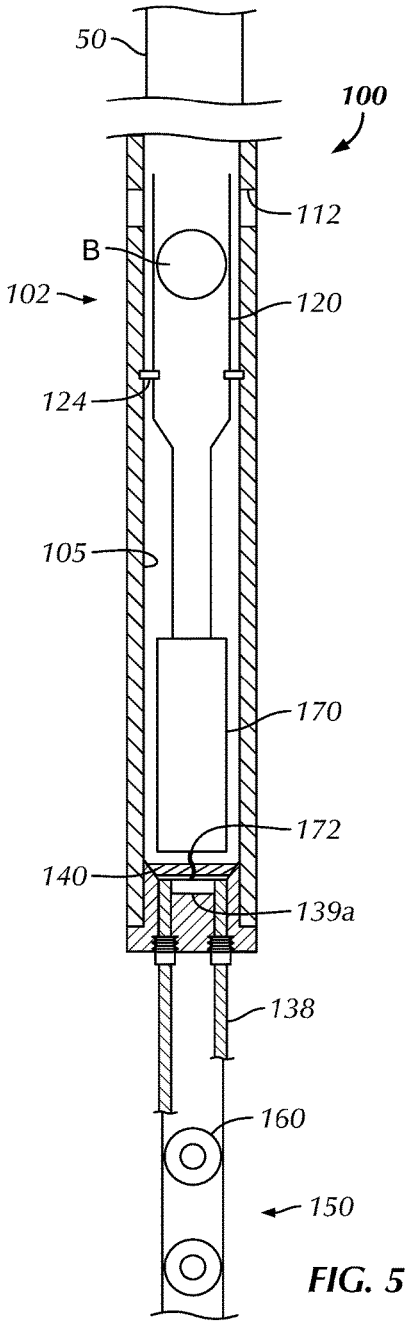
FIG. 5 schematically illustrates another tubing conveyed apparatus according to the present disclosure.

In another embodiment, the mechanical firing system can deliver an electric pulse to initiate the external detonator components. In particular, a through-wire pressure bulkhead can isolate a source of electric power from the wellbore environment and can transfer electric energy to the external detonator components through a barrier. For example, FIG. 5 schematically illustrates another tubing conveyed apparatus 100 according to the present disclosure that uses electric delivery. Many of the same components discussed above are used with this apparatus 100 so that like reference numerals are used.

As before, the apparatus 100 is conveyed by tubing 50 in a wellbore in a manner similar to the techniques discussed above. The tubing 50 can be coiled tubing, jointed pipe, or the like and can be deployed with coil tubing equipment, a rig, and the like.

As before, the apparatus 100 includes a body having the first and second portions 102 and 104. The first portion 102 is in fluid communication with the tubing 50, whereas the second portion 104 is exposed in the wellbore when deployed therein. A barrier 140 seals between the first and second portions 102 and 104.

The apparatus 110 has a tubing-conveyed firing mechanism 110 at the first portion 102. The firing mechanism 110 is mechanically actuated and initiates an electrical source 170 that transfers an electric pulse from the hollow chamber 105 of the first portion 102 and through the barrier or bulkhead 140 to initiate detonation of the components of the second portion 104 external to the environmentally-protected chamber 105. The electric pulse can be transferred via one or more conductors or wires 172 passing sealed through the barrier 140. The transfer of the electric pulse energy then detonates boosters 139*a* and/or detonating cords 138 as a part of a larger detonation chain of energetic members 160, such as perforating charges, propellant materials, oxidizers, energetic materials, cutter, string shots, or any other energetic members utilized within or external to a wellbore.

As noted above, the first portion 102 includes the firing mechanism 110 for initiating firing of the energetic members 160 on the second portion 104. For example, the firing mechanism 110 can include a sleeve 120 disposed in the housing 111. The seat 122 of the sleeve 120 can engage a deployed device or ball B, and tubing pressure behind the seated ball B shifts the sleeve 120 from of shear pins 124 or other temporary connection. Shifting of the sleeve 120 then actuates the electrical source 170. Shifting of the sleeve 120 can also move the sleeve 120 relative to external ports 112 on the mechanism's housing 111 to allow fluid communication from the tubing to the surrounding wellbore.

The electrical source 170 can be a magneto-based device, a piezoelectric device, or another device that produces an electric pulse in response to mechanics. In the current example, triggering of the electric pulse is mechanically actuated with tubing pressure applied behind the seated ball B moving the sleeve 120. The electric source 170 may store the electric charge and release it in response to the mechanical trigger, or the electric source 170 may generate the electric charge with the mechanical trigger.

As will be appreciated, other mechanical triggers can be used, such as other forms of tubing pressure, a drop bar, or an annular pressure, depending on the hookup downhole. In general, pressure, impact, movement, friction, and the like from the mechanical actuation of the firing mechanism 110 can produce the electric pulse from the source 170 that then travels via the wires 172 through the sealed bulkhead 140 to the detonation train hardware on the external portion 104 of the apparatus 100.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An apparatus conveyed with tubing downhole in a wellbore, the apparatus comprising:

a body having first and second portions, the first portion being in fluid communication with the tubing, the second portion being exposed in the wellbore;

a barrier sealing between the first and second portions;

energetic material disposed on the second portion and connected to a detonating cord extending toward the barrier;

a firing mechanism disposed in the first portion and being mechanically actuated, wherein the firing mechanism comprises a firing pin disposed in the first portion and being movable to a firing position in response to fluid pressure from the tubing, wherein the first portion comprises a sleeve movable therein in response the fluid pressure from the tubing and moving the firing pin to the firing position; and a detonation mechanism at least partially disposed in the first portion, the detonation mechanism initiating a detonation in response to the mechanical actuation of the firing mechanism and transferring the detonation across the barrier to the detonating cord for the energetic material.

2. The apparatus of claim 1, wherein the detonation mechanism comprises:

a detonator disposed in the first portion relative to the firing pin and being detonated in response to the firing pin moved to the firing position; and a ballistic transfer in communication with the detonator and transferring the detonation from the detonator across the barrier to the detonating cord for the energetic material.

3. The apparatus of claim 1, wherein the sleeve comprises a seat engageable by a plug deployed down the tubing, the seat sealing with the plug and permitting the fluid pressure from the tubing to move the sleeve in the first portion.

4. The apparatus of claim 1, wherein the barrier comprises a membrane composed of metal and sealing fluid communication between the first portion and the wellbore.

5. The apparatus of claim 1, wherein the second portion comprises an arm extending from the first portion and having the energetic material disposed thereon.

6. The apparatus of claim 1, wherein the energetic material comprises one or more perforating charges, propellant materials, oxidizers, cutters, and string shots.

7. An apparatus conveyed with tubing downhole in a wellbore, the apparatus comprising:

a body having first and second portions, the first portion being in fluid communication with the tubing, the second portion being exposed in the wellbore;

a barrier sealing between the first and second portions;

energetic material disposed on the second portion and connected to a detonating cord extending toward the barrier;

a firing mechanism disposed in the first portion and being mechanically actuated; and a detonation mechanism at least partially disposed in the first portion, the detonation mechanism initiating a detonation in response to the mechanical actuation of the firing mechanism and transferring the detonation across the barrier to the detonating cord for the energetic material, wherein the detonation mechanism comprises an electric source disposed in the first portion and producing an electric pulse in response to the mechanical actuation of the firing mechanism.

8. The apparatus of claim 7, wherein the barrier comprises a sealed bulkhead between the first portion and the wellbore and passing at least one conductor for the electric pulse from the electric source.

9. The apparatus of claim 7, wherein the electric source comprises a magneto-based device or a piezoelectric device.

10. The apparatus of claim 7, wherein the first portion comprises a sleeve movable therein in response to the fluid pressure from the tubing and providing the mechanical actuation to the detonation mechanism.

11. The apparatus of claim 10, wherein the sleeve comprises a seat engageable by a plug deployed down the tubing, the seat sealing with the plug and permitting the fluid pressure from the tubing to move the sleeve.

12. The apparatus of claim 7, wherein the barrier comprises a membrane composed of metal and sealing fluid communication between the first portion and the wellbore.

13. A method of energizing energetic material downhole in a wellbore, the method comprising, not necessarily in sequence:

sealing a barrier between first and second portions of an apparatus;

connecting the first portion to tubing;

disposing the energetic material on the second portion;

deploying the apparatus on the tubing downhole in the wellbore with the first portion in fluid communication with the tubing and the second portion exposed in the wellbore;

mechanically actuating a firing in the first portion by moving a firing pin disposed in the first portion to a firing position in response to fluid pressure from the tubing, wherein moving the firing pin comprises engaging a plug deployed down the tubing on a seat of a sleeve, and moving the sleeve in response to the fluid pressure from the tubing applied against the seated plug;

initiating a detonation in the first portion in response to the mechanical actuation of the firing; and transferring the detonation across the barrier to the energetic material exposed in the wellbore on the second portion.

14. The method of claim 13, wherein initiating the detonation in the first portion in response to the mechanical actuation of the firing comprises detonating a detonator disposed in the first portion in response to the firing pin moved to the firing position.

15. The method of claim 14, wherein transferring the detonation across the barrier to the energetic material exposed in the wellbore on the second portion comprises transferring the detonation from the detonator across the barrier to the energetic material with a ballistic transfer in communication with the detonator.

16. The method of claim 13, wherein the barrier comprises a membrane composed of metal and sealing fluid communication between the first portion and the wellbore.

17. The method of claim 13, wherein the energetic material comprises one or more perforating charges, propellant materials, oxidizers, cutters, and string shots.

18. A method of energizing energetic material downhole in a wellbore, the method comprising, not necessarily in sequence:

sealing a barrier between first and second portions of an apparatus;

connecting the first portion to tubing;

disposing the energetic material on the second portion;

deploying the apparatus on the tubing downhole in the wellbore with the first portion in fluid communication with the tubing and the second portion exposed in the wellbore;

mechanically actuating a firing in the first portion;

initiating a detonation in the first portion in response to the mechanical actuation of the firing by producing an electric pulse with an electric source in response to the mechanical actuation of the firing mechanism; and transferring the detonation across the barrier to the energetic material exposed in the wellbore on the second portion.

19. The method of claim 18, wherein transferring the detonation across the barrier to the energetic material exposed in the wellbore on the second portion comprises conducting the electric pulse from the electric source via at least one conductor passing through a sealed bulkhead for the barrier between the first portion and the wellbore.

20. The method of claim 18, wherein the electric source comprises a magneto-based device or a piezoelectric device.

21. The method of claim 18, wherein mechanically actuating the firing in the first portion comprises engaging a plug deployed down the tubing on a seat of a sleeve, and moving the sleeve in response to fluid pressure from the tubing applied against the seated plug to initiate the detonation in the first portion.

* * * * *